US006960712B2

(12) United States Patent
Citron et al.

(10) Patent No.: US 6,960,712 B2
(45) Date of Patent: Nov. 1, 2005

(54) POLYMERIC DRUMSTICKS

(75) Inventors: Joel David Citron, Wilmington, DE (US); Michael Robert Samuels, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/339,610

(22) Filed: Jan. 9, 2003

(65) Prior Publication Data

US 2003/0209129 A1 Nov. 13, 2003

Related U.S. Application Data

(63) Continuation-in-part of application No. 10/130,028, filed on May 9, 2002.

(51) Int. Cl.[7] ..... G10D 13/02
(52) U.S. Cl. ..... 84/422.2
(58) Field of Search ..... 84/422.4

(56) References Cited

U.S. PATENT DOCUMENTS 5,602,355 A * 2/1997 Lipp ..... 84/422.4

OTHER PUBLICATIONS

Modern Plastics, Oct. 1999.

* cited by examiner

*Primary Examiner*—Kimberly Lockett

(57) ABSTRACT

Drumsticks made from thermoplastic or thermoset resin compositions containing a reinforcing agent and having certain physical properties are readily formed, have good playing characteristics, and are durable.

15 Claims, 2 Drawing Sheets

POLYMERIC DRUMSTICKS

This is a continuation-in-part of application No. 10/130,028, filed May 9, 2002.

FIELD OF THE INVENTION

This invention concerns compositions made from isotropic thermoplastics (ITPS) or thermoset resins (TSRs) and reinforcing agents (RAs) having certain physical properties which are useful in drumsticks.

TECHNICAL BACKGROUND

Drumsticks for percussionists have traditionally been most often made from wood, usually a hardwood such as American hickory which is straight grained and readily shaped. Usually a rod of the wood is turned to produce the desired shape, the wood is smoothed if necessary, and then coated with a finish. Although wood sticks have been used for many years, and have been found satisfactory, they have some drawbacks, such as a tendency to break along the grain. Therefore improved drumsticks are needed.

Thermoplastics have been thought of for drumsticks, but the stiffness and other properties of most thermoplastics are too low to afford good drumsticks. Recently [see Modern Plastics, vol. 76, No. 10, p. 41 (October 1999)] it has been reported that oriented polymers, such as oriented polypropylene, can be used for drumsticks, but these sticks are relatively expensive to form, requiring one or more orientation steps, then turning (much as in making wood drumsticks) to form the final shape. This manufacturing process does not allow for taking advantage of some of properties of thermoplastics, such as inexpensive and easy formability. Drumsticks which are made from ITPs or TSRs and RAs, having certain physical properties, may be simply melt formed, as by injection molding for ITPs and reaction injection molding for TSRs, and have the requisite properties for drumsticks without further processing.

SUMMARY OF THE INVENTION

This invention concerns a drumstick, comprising a composition comprising:

(i) one or more isotropic thermoplastics or one or more thermoset resins; blended with (ii) a reinforcing agent; provided that sufficient reinforcing agent is added so that a flexural modulus of said composition is about 6.9 GPa or more when measured by ASTM Method D790.

DETAILS OF THE INVENTION

Figure 1:
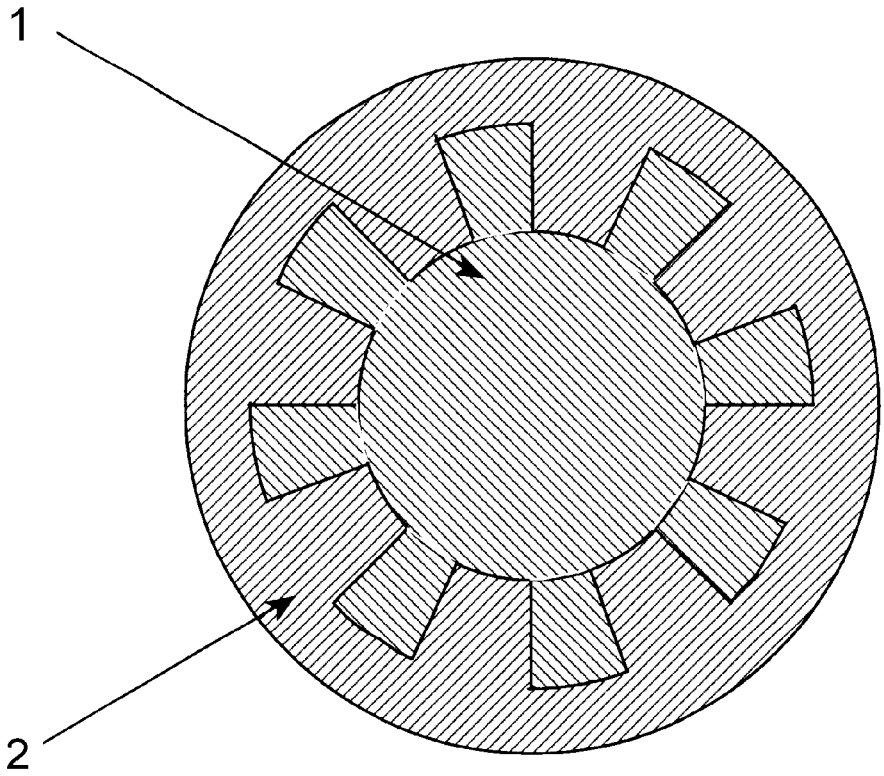
FIG. 1 shows a cross section of a drumstick towards the handle end having a core made from the compositions described herein.

The drumstick described herein comprises a composition comprising one or more ITPs or one or more TSRs, and one or more PAs which are mixed with the polymers. In addition other components may be present ("comprises") in the drumstick, and/or other materials may be present in the blends (mixtures) of the ITPs or TSRs with the RAs. The composition containing the ITPs or TSRs may contain other blended materials such as one or more fillers, antioxidants, pigments, dyes, or other materials normally found in ITPs or RAs. The ITP or TSR compositions with reinforcing agent may also contain more than one ITP or TSR, respectively, in other words be a blend of polymers also. The other ingredients (if any) may be used to change the appearance (color for instance) of the drumstick, and/or may also affect the acoustical properties of the drumstick. For the compositions containing ITPs or TSRs, blend of two or more ITPs or TSRs may be used, respectively (in addition to other ingredients such as reinforcing agent).

By an ITP is meant a polymer that is isotropic when tested in the "TOT Test" described in U.S. Pat. No. 4,118,372 ITPs include most types of thermoplastic polymers (specific illustrative polymers in parentheses), such as polyesters [poly (ethylene terephthalate), poly(1,4-butylene terephthalate), poly(1,4-cyclohexanedimethamol terephthalate)], polyamides (nylon-6,6, nylon-6), polyolefins (polyethylene, polypropylene, polystyrene), and poly(meth)acrylates [poly (methyl methacrylate)]. By a TSR is meant a polymer which crosslinks upon being melt formed, for example by being heated with a crosslinking agent during the forming process. Such polymers include epoxy, melamine, phenolic, and urethane resins. ITPs are preferred types of polymers.

By a reinforcing agent is meant a material or combination of materials that wen mixed with the resin (ITP or TSR) increases the flexural modulus of the composition. Typical reinforcing agents are fibrous materials such as glass fibers, aramid fibers and carbon fibers, minerals such as clay, mica and talc, powders such as $TiO_2$, carbon black, hollow glass spheres, and milled glass (which may be milled glass fiber and so may have some fiber characteristics), quartz powder, and the like. Preferably the composition contains about 5 to about 60 weight percent of the reinforcing agent, more preferably about 10 to about 50 weight percent of the reinforcing agent. A preferred type of reinforcing agent is a material that has an aspect ratio, that is the ratio of the longest dimension of the particle to the shortest dimension of the particle of about 3 or more, more preferably about 10 or more. Such materials include platy materials such as talc and mica, and fibers, usually chopped fiber of relatively short lengths such as glass and aramid fibers. Chopped fibers are preferred reinforcing agents, and (chopped) glass fiber is more preferred.

Sufficient reinforcing agent is added so that the flexural modulus, when measured by ASTM Method D790 at 23° C. using parts made to the correct dimensions by molding, preferably 0.32 cm (⅛ inch) thick, and tested flatwise, is about 6.9 GPa or more, preferably about 10 GPa or more, and especially preferably 12 GPa or more. Also preferably, when measured the same way by ASTM Test Method D790 the flexural strength is about 100 MPa or more, more preferably about 140 MPa or more, and especially preferably about 160 MPa or more. Alternatively (to flexural strength), the composition may have a flexural elongation of 5.0 percent or more. Any of the flexural modulus limitations may be combined with any of the flexural strength or elongation limitations.

The reinforcing agent is mixed with the polymer chosen by various methods known in the art. For instance, if an ITP is used, it may be melt mixed with the reinforcing agent (and any other ingredients which may be present in the final composition) in a typical melt mixing apparatus such as a single or twin screw extruder, or a kneader. If a thermoset resin is used it may be melt mixed before crosslinking with the reinforcing agent and any other ingredients to be present in mixers typically used for mixing thermoset resins such a extruders or kneaders. In all instances it is preferred that the reinforcing is uniformly mixed into the polymer used and is dispersed therein.

If the drumstick is made using an ITP composition (meaning the ITP plus reinforcing agents and any fillers, antioxidants, pigments dyes or other materials normally found in thermoplastic.) the drumstick may simply be melt formed in any desired shape or size from the ITP (see for instance H. Mark, et al., Ed., Encyclopedia of Polymer Science and Engineering, Vol. 8, John Wiley & Sons, New York, 1987, p. 102–139, which is included herein by reference). For example, the drumstick may be injection molded. In order to achieve a high degree of stiffness along the length of the drumstick (as it is in a wood drumstick) when a reinforcing filler with an aspect ratio of more than one is used, and particularly preferably when a fiber is used as the reinforcing agent, it is preferred to place the gate of the mold at one end of drumstick cavity, preferably the end which is the handle (not the end for hitting the drum or other instrument). The reinforcing agent or other added ingredients such as fillers may be chosen to adjust the weight of the stick, by choosing a reinforcing agent and/or filler (if present) with an appropriately low or high density. If the drumstick is made from a TSR, typical thermoset resin forming processes, such as compression molding, transfer mold or reaction injection molding, may be used, see for instance H. Mark, et al., Ed., Encyclopedia of Polymer Science and Engineering, Vol. 4, John Wiley & Sons, New York, 1986, p. 79–108, and H. Mark, et al., Ed., Encyclopedia of Polymer Science and Engineering, Vol. 14, John Wiley & Sons, New York, 1988, p. 72–100, both of which are hereby included by reference.

The ITP or TSR composition described above may also be present as one or more cores (also called inserts or insert molding) or the outer material of the drumstick. In either case this composition lends stiffness and other desirable properties to the drumstick. If this composition is used as a core, it may have a cross section (through at least most of the length) as shown in FIG. 1. The core, 1, in spline form, may be formed by melt forming, for example by extrusion or injection molding, much as a drumstick formed completely from the composition would be formed. The core may then be overmolded with a second thermoplastic, 2. Useful second thermoplastics include polyolefins such as polyethylene, polypropylene and polystyrene, polyesters such as poly(ethylene terephthalate) and poly(butylene terephthalate), polyamides such as nylon-6 and nylon-6,6, and other thermoplastics such as polysulfones, polyethers, polyurethanes. The core may also be overmolded with a second thermoset resin. The core may be overmolded by any usual technique used to overmold thermoplastics or thermosets. Herein "second" thermosets, thermoplastics and polymers mean such resins or compositions containing such resins which do not meet the criteria for the compositions described herein, such as no or too little reinforcing filler, and/or low flexural modulus.

Conversely, a second thermoplastic or second thermoset composition or other material may be used for a core, and an ITP or TSR composition described above overmolded over that core to form the drumstick. Again any normal method of overmolding may be used. In this process it is often preferred that the overmolding composition have a relatively low melting point so as not to melt or otherwise damage the already existing core. Whichever material is used for the core, the core may be mechanically "locked" to the overmolding by molding into the core shape appropriate angles, overlaps or other discontinuities that cause such mechanical locking.

Figure 2:
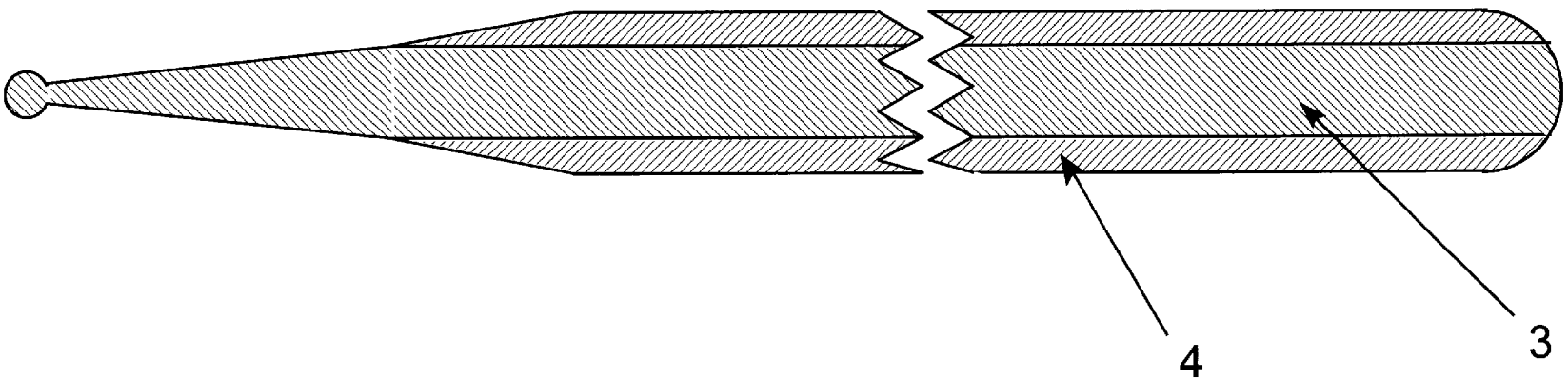
FIG. 2 shows a longitudinal cross section of a drumstick having a core made from the compositions described herein and a partial thermoplastic overmolding.

The drumstick may also be constructed where part of the exposed surface is an ITP or TSR composition as described above, and part of the length of the drumstick is overmolded with a second polymer, as is shown in FIG. 2. In FIG. 2, which is a longitudinal cross section of a drum stick, the ITP or TSR composition core, 3, extends beyond the overmolded second thermoplastic jacket 4, and this core also is the tip of the drumstick. The ITP or TSR composition core in FIG. 2 may have a cross section similar to that shown in FIG. 1, until the point where it emerges from under 4. The ITP or TSR compositions portion and portion made from second polymer compositions in FIG. 2 may also be reversed.

As some wooden drumsticks are now made, the striking end of these drumsticks may be covered by another material such as a second thermoplastic, for example a polyamide such as nylon-6 or nylon-6,6. The striking end of the molded drumstick may be configured so that the added tip may slip over that end and be locked onto the end by mechanical means (so-called snap fit). The drumstick may have fastened to it at its end felt or other material which is the surface that actually strikes the drum, as is typical with tympani mallets (sticks).

These drumstick may also be hollow to some extent (through part of all or the length, especially the hand held section) to adjust the weight of the drumstick, adjust the acoustical response. Alternatively for the same reasons these drumsticks may be partially or fully foamed to form a rigid foam.

Unlike turned drumsticks, such as most wooden drumsticks and oriented polymer drumsticks, the cross section of the present molded drumsticks need not be circular, and contoured and/or curved drumsticks, which may be easier or less tiring to grip, may be readily formed. Such drumsticks may be ergonomically superior to the classical straight drumstick, and/or the cross section may be varied to change the balance of the drumstick. For a drumstick, such as shown in FIG. 2, the outer layer may also be a thermoplastic or thermoset elastomer, preferably a thermoplastic elastomer. The use of an elastomeric outer layer may allow the drumstick to be used with less fatigue by the percussionist, and/or change the acoustical properties of the drumstick. A useful thermoplastic elastomer is a block copolymer containing polyester segments and polyether segments, such as is available under the tradename Hytrel® from the DuPont Co., Wilmington, Del., U.S.A. The present containing drumsticks are durable, and their acoustical properties may sometimes be adjusted.

What is claimed is:

1. A drumstick, comprising, a composition comprising:

(i) one or more isotropic thermoplastics or one or more thermoset resins; blended with (ii) a reinforcing agent;

provided that sufficient reinforcing agent is added so that a flexural modulus of said composition is about 6.9 MPa GPa or more when measured by ASTM Method D790.

2. The drumstick, as recited in claim 1, wherein said composition comprises one or more isotropic thermoplastics.

3. The drumstick as recited in claim 1 wherein said reinforcing agent comprises a fiber.

4. The drumstick, as recited in claim 1 wherein said composition comprises one or more thermoset polymers.

5. The drumstick as recited in claim 1 wherein said composition has said flexural modulus of about 12 GPa or more.

6. The drumstick as recited in claim 1 wherein said composition has a flexural strength as measured by ASTM Method D790 of about 100 MPa or more.

7. The drumstick as recited in claim 5, wherein said composition has a flexural strength as measured by ASTM Method D790 of about 100 MPa or more.

8. The drumstick, as recited in claim 1, which is contoured, or curved, or contoured and curved.

9. The drumstick as recited in claim 1 which has a varying cross section.

10. The drumstick as recited in claim 8 which has a varying cross section.

11. The drumstick, as recited in claim 1, which is partially foamed.

12. The drumstick, as recited in claim 1, which is at least partially hollow.

13. The drumstick, as recited in claim 3, wherein said fiber comprises fiberglass.

14. The drumstick as recited in claim 1 which has one or more of the following features:

(a) at least part of the drumstick does not have a circular cross section;

(b) at least part of the drumstick is contoured; and (c) the drumstick has one or more curves through its length.

15. The drumstick, as recited in claim 1, wherein any fiber present is chopped fiber.

* * * * *